United States Patent [19]

Filmyer

[11] 4,391,393

[45] Jul. 5, 1983

[54] WETTED SALT SYSTEM INCLUDING ADJUSTABLE TIMER

[75] Inventor: Wm. G. Filmyer, Philadelphia, Pa.

[73] Assignee: Pioneer De-Icing Services, Inc., Philadelphia, Pa.

[21] Appl. No.: 345,572

[22] Filed: Feb. 4, 1982

Related U.S. Application Data

[63] Continuation of Ser. No. 67,304, Aug. 17, 1979, abandoned.

[51] Int. Cl.[3] ..... B67D 5/02

[52] U.S. Cl. ..... 222/642; 239/70

[58] Field of Search ..... 222/639, 642; 239/70

[56] References Cited

U.S. PATENT DOCUMENTS 3,205,717 9/1965 Alston et al. ..... 239/70 X

OTHER PUBLICATIONS

*Pioneer De-Icing Services,* Division of Pioneer Salt & Chemical Co., 940 N. Delaware Ave., Philadelphia, Pa., 19123.

*Caltreat,* Allied Chemical Canada, Ltd.

*Primary Examiner*—Robert B. Reeves

*Assistant Examiner*—Edward M. Wacyra

*Attorney, Agent, or Firm*—Weiser, Stapler & Spivak

[57] ABSTRACT

An improved wetted salt system to extend the melting range of highway salt includes a control system having a manual, external timer that can be easily field adjusted by non-skilled personnel to vary the quantity of calcium chloride delivered through the spray nozzles during each application cycle. The system incorporates a liquid storage tank and a hydraulic unit capable of delivering liquid calcium chloride from the tank through a wetting arm to spray nozzles for direct application upon a salt load. The control system, including the manual timer, controls a hydraulic unit to pivotally function the wetting arm upon each application cycle and to adjustably time spray intervals for precise rate of application control.

1 Claim, 7 Drawing Figures

WETTED SALT SYSTEM INCLUDING ADJUSTABLE TIMER

This is a continuation of application Ser. No. 067,304, filed Aug. 17, 1979, now abandoned.

BACKGROUND OF THE INVENTION

The present invention relates generally to the field of highway snow and ice melting procedures, and more particularly, is directed to a system suitable to extend the melting capability and efficiency of highway ice control salt.

In northern latitudes, it is common practice to provide increased highway safety during the winter months by applying common salt in granular or pellet sizes directly upon accumulations of ice and snow in the road surface to thereby effect early melting and consequential highway clearing, even at temperatures below 32° F. Large, open trucks equipped with salt spreading apparatus and capable of being filled with usual front end loaders are normally employed for this purpose. Additionally, it has also been common practice to apply a gritty material, such as sand or cinders, upon accumulations of highway ice in order to further render highway systems safer for travel by automobile during the winter months.

In the case of the application of salt particles, it has been found that the usual sodium chloride salt application works well enough to melt rather quickly the accumulations of ice and snow from most winter storms when ambient temperatures are either above freezing or slightly below freezing. However, as the weather conditions become worse and temperatures decline, the clearing of accumulations of ice and snow from highway surfaces becomes increasingly more difficult due to the slower melting that can be expected, even after repeated applications of dry salt. Additionally, as the temperature drops, the salt particles have a tendency to bounce upon the cold highway surface as they are delivered upon the road surface by the spreading equipment and thus do not remain in the desired pattern directly within the cartway wherein the melting of the ice is most desirable and necessary.

In order to improve the snow and ice melting capabilities of highway salt at lower temperatures, prior workers in the field have found that the addition of dry calcium chloride pellets to the dry sodium chloride salt has increased snow and ice melting capabilities of the salt, especially at temperatures below 25° F. As the ambient temperatures have declined, increased amounts of dry calcium chloride pellets have been added in an effort to provide improved snow and ice melting at such lower temperatures. While the addition of calcium chloride pellets did provide increased snow and ice melting capability of the highway salt, the lower temperatures resulted in slower melting. Additionally, the problem of pellet "bounce" remained and a considerable portion of the applied material did not remain in the location of application and accordingly, was not available to promote melting where most needed.

Prior workers in the art have developed wetted salt systems suitable to apply a brine solution of liquid calcium chloride to sodium chloride salt granules prior to application upon a highway surface for snow and ice melting during periods of below freezing temperatures.

Such prior systems have included liquid storage tanks of suitable construction and capacity which were provided with necessary fittings to both store a quantity of liquid calcium chloride solution without corrosion and to feed the brine solution to delivery equipment for subsequent automatically controlled spraying upon loads of highway ice melting salt.

The prior systems have incorporated a hydraulic pump and a brine pump which were designed and provided to receive brine from the storage tank and to deliver the brine solution to a wetting arm for direct application upon each load of highway salt granules as the salt was delivered to a conventional spreader truck by a suitable truck loading apparatus, such as a front end loader.

The wetting arm was pivotal in nature to facilitate application of the brine solution during the truck loading operation and the pivotal operation of the arm was functioned and controlled by the hydraulic unit. In the usual application, the bucket of a front end loader or the storage compartment of the truck was moved to the wetting arm which was then lowered and the brine solution was applied directly upon the salt through spray pattern nozzles. After each application of the brine solution, the wetting arm was pivotally raised or otherwise moved to facilitate free movement of the loading equipment and the truck. The length of the spray cycle was usually controlled by one or more timers as part of the control circuit. As is usual with most available timers, the timed period of operation had to be set directly within the timer itself. Such wettings had to be made by skilled personnel using the necessary tools to effect timer adjustment. Problems have occurred wherein changes in weather conditions or in load conditions would have indicated that a different timer setting could be more advantageously employed to adjust the quantity of liquid calcium chloride being applied. However, with existing equipment, there was no easy or timely method for making any such adjustment.

SUMMARY OF THE INVENTION

To enhance the universal applicability of the apparatus and system to permit use under substantially all field conditions, the wetted salt system of the present invention includes a manual, external, timer adjustment, mounted directly upon the control cabinet to permit adjustment of the spray time cycle by even unskilled personnel from without the cabinet without need to use a screwdriver or other tool directly upon the timers. Inasmuch as timer adjustment generally is a precise operation and usually requires skilled workers to perform the adjustment, the novel, manual timer adjustment of the present system provides an easily operated device that is capable of immediate field adjustment without the need to wait for the arrival of a skilled mechanic. Accordingly, as weather conditions change from time to time during the operating period, it is contemplated that a foreman or similar employee can change the timer dial settings directly and immediately to achieve maximum snow and ice melting results.

The manual, external timer adjustment provides a municipality with a means in the nature of a manual timer to adapt the system to accommodate a variety of winter conditions and equipment differences, without requiring factory adjustment or specialized equipment. The manually adjustable spray timer may be variable from one to one hundred and fifty seconds to provide an easy means for changing gallons per ton of spray cycle to accommodate a wide range of temperatures. This will permit a municipality to use less solution at higher temperatures, thus saving money, and more solution at lower temperatures, thus getting better results.

The manually adjustable timer provides a municipality with the ability to make use of various pieces of loading equipment, when necessary, in the event of front end loader breakdown or substitution. The simple turn of the timer knob to the appropriate setting is all that will be necessary to complete the adjustment. In the event of emergency loading conditions or a routine procedural change, the system may be easily recalibrated to accommodate the spraying of one bucket load of salt at a time, up to the entire truck load at once. Again, this can be accomplished by the turn of the adjustable timer control knob manually, even by unskilled personnel.

It is therefore an object of the present invention to provide an improved wetted salt system of the type set forth.

It is another object of the present invention to provide a novel wetted salt system including in combination a manually adjustable timer, a liquid calcium chloride storage tank, a pivotally mounted wetted arm, a hydraulic unit suitable both to deliver liquid calcium chloride to the wetting arm and to pivotally function the wetting arm, and a suitable control system which is operable with the manual timer to initiate, time and terminate the cycle of operation.

It is another object of the present invention to provide a novel wetted salt system including manually adjustable timer to control a hydraulic unit which is capable of delivering a brine solution to a wetting arm including spray nozzles and a control system incorporating the manual timer and adopted to time the pivotal movement of the arm and the time period of brine spray delivered by the arm.

It is another object of the present invention to provide a novel wetted salt system including in combination brine storage means, brine pump means, a wetting arm adapted to deliver brine from the storage means in a spray pattern upon successive salt loads and manual means to vary the time period of spray wherein the manual means can be operated by unskilled personnel.

It is another objection of the present invention to provide a novel wetted salt system that is rugged in construction, inexpensive in manufacture and trouble free when in use.

Other objects and a better understanding of the invention will be had by referring to the following description and claims of a preferred embodiment of the invention, taken in conjunction with the accompanying drawings, wherein like reference characters refer to similar parts throughout the several views and in which:

DESCRIPTION OF THE PREFERRED EMBODIMENT OF THE INVENTION

Figure 1:
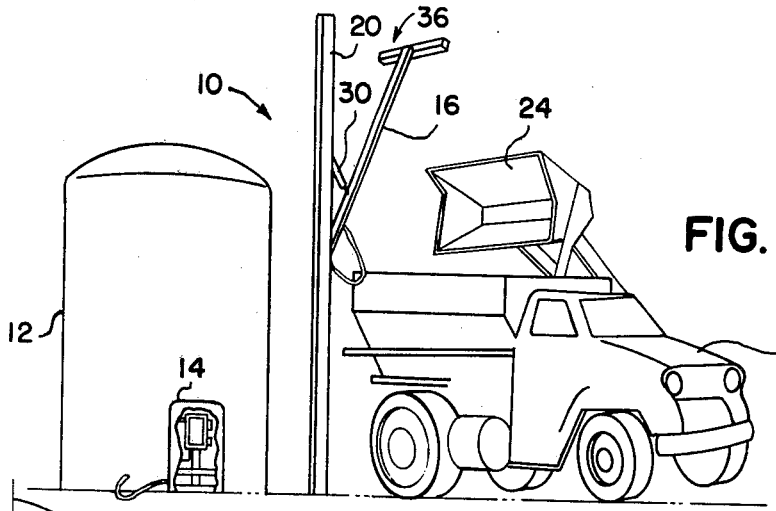
FIG. 1 is a perspective view showing the apparatus of the wetted salt system in use.

Although specific terms are used in the following description for the sake of clarity, these terms are intended to refer only to the particular structure of the invention selected for illustration in the drawings and are not intended to define or limit the scope of the invention.

Figure 2:
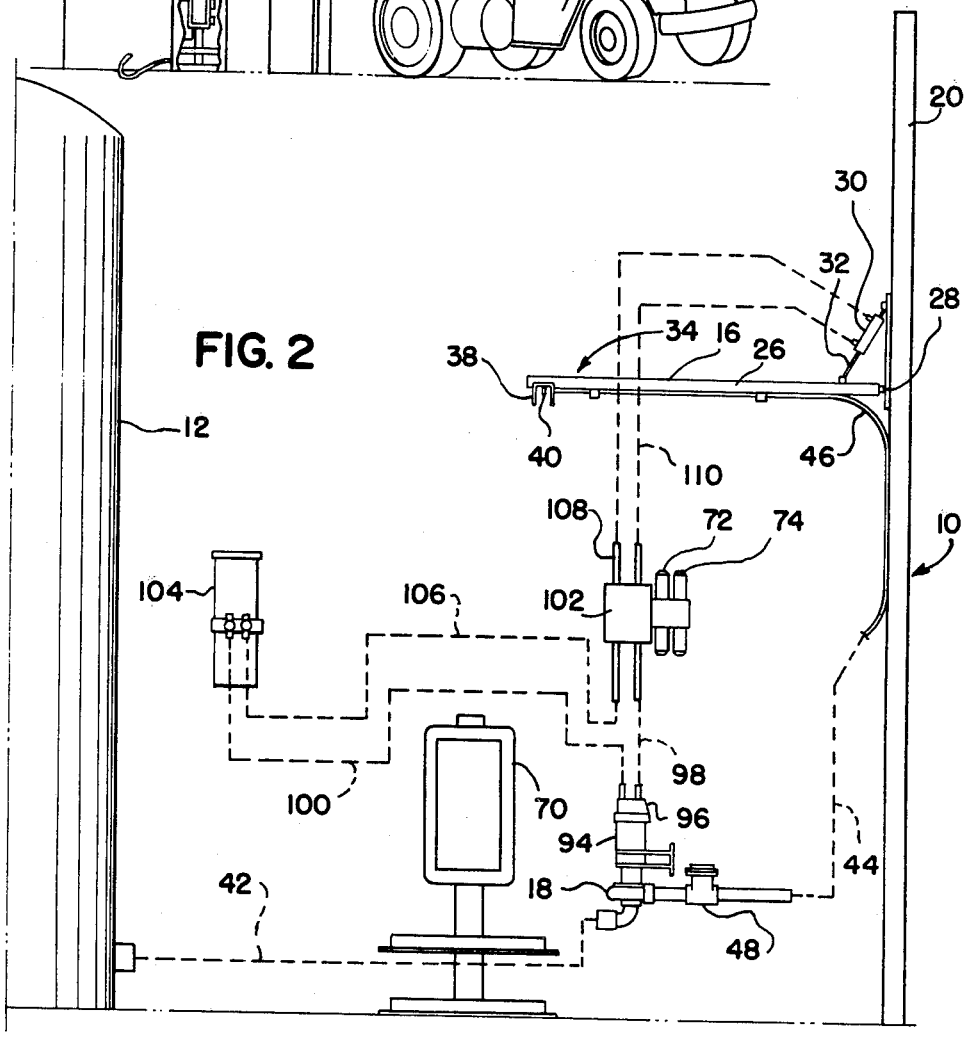
FIG. 2 is an enlarged, schematic, elevational view showing the arrangement of parts.

Referring now to the drawings, there is illustrated in FIGS. 1 and 2 a wetted salt system generally designated 10 which comprises generally a storage tank 12 for storing a quantity of liquid calcium chloride (not shown). Preferably, the storage tank 12 is installed as an above ground tank and is constructed of suitable material to safely store the liquid calcium chloride, for example high density cross linked polyolefin of suitable thickness and construction to provide adequate structural strength for the service.

A control enclosure 14 is mounted adjacent to the storage tank 12 and contains therein in a neat, compact assembly the control components of the system including radio receivers, timers, relays, the hydraulic system and the pump system as necessary for a workable, automatic installation as hereinafter more fully described in detail. The control enclosure 14 additionally mounts the manually adjustable timer 112 to provide the system with on site adjustment capability to easily compensate for varying weather conditions. The liquid calcium chloride from the storage tank 12 is pumped to the wetting arm 16 by the pump 18 in response to automatic control as hereinafter more fully described. The wetting arm 16 may be pivotally mounted upon a vertical standard 20 or other elevated, sturdy construction in position to apply a spray pattern of calcium chloride salt upon granular sodium chloride prior to application to the highway. In practice, the liquid material may be applied directly to the sodium chloride contained within the storage bin of a spreader truck 22 or preferably, is applied to each load of sodium chloride directly in the load bucket 24 of a front end loader immediately prior to dumping into the storage bin of the spreader truck 22.

The hand adjustable spray tmer 112 provides the system user with easy means to vary the gallons of calcium chloride liquid applied during each spray cycle to accommodate a wide range of temperatures. This permits the use of less solution at higher temperatures to thus save money, and more solution at lower temperatures to thus assure better results. The variable timer 112 provides the ability in the system to make use of various pieces of loading equipment, when necessary, in the event of front end loader breakdown or substitution of equipment. The simple turn of the timer knob to the appropriate setting is all that is necessary to complete the adjustment, thereby eliminating the need for specially trained personnel or for special tools. In the event of emergency loading conditions or a routine procedural change, the control system may be easily recalibrated to accommodate the spraying of one bucket load of salt at a time, up to the entire truck load at once. Again, this can be accomplished easily and simply by the turn of the adjustable timer 112 control knob.

Still referring to FIGS. 1 and 2, the wetting arm 16 comprises an elongated bar 26 which extends outwardly from the vertical standard 20 through a pivotal connection 28. A hydraulic cylinder 30 is secured to the standard 20 and has its piston arm 32 operatively connected to the wetting arm bar 26 to pivotally move the wetting arm 16 relative to the vertical standard 20. In response to controls contained within the control enclosure 14, the cylinder 30 functions to pivotally move the wetting arm 16 between the spraying position 34 as illustrated in FIG. 2 to the initial elevated position 36 as illustrated in FIG. 1 to enable the close approach of the highway salt handling equipment 22, 24 for spray application purposes.

A channel shaped spray head 38 is affixed at right angles to the bar 26 to facilitate the application of a relatively wide spray pattern of liquid calcium chloride salt upon the granular salt articles contained within either the truck 22 or the loader 24 as may be desired by the operators. A plurality of spray nozzles 40 are mounted within the spray channel 28 for application of the calcium chloride solution to the surface area of the granular salt (not shown) either while in the end loader bucket 24 or within the spreading equipment 22. Typically, the system can be controlled to apply approximately 10 gallons of liquid calcium chloride solution per ton of salt within approximately a 30 to 35 second cycle. In response to automatic controls, the pump 18 receives the calcium chloride solution from the storage tank 12 through the suction line 42 and discharges the solution at suitable head pressure through the control valve 48, and the discharge line 44 to the flexible conduit 46 for delivery to the spray nozzles 40 at suitable pressure to apply the desired quantity of solution within a relatively rapid timed cycle of spraying.

The wetted salt system 10 can be automatically functioned by remote radio transmitters (not shown) which are functioned by the operators of the salt loading or spreading equipment 22, 24 or by other workers (not shown) employed in the operation. Normally, the cylinder 30 functions the wetting arm 16 to its elevated position 36 at the end of each cycle as indicated in FIG. 1. When it is desired to spray a load of granular salt within either the front end loader 24 or within the spreading apparatus 22, the operator (not shown) functions his transmitter (also not shown) to activate the receiver 50 which is the down spray radio control. Activation of the receiver 50 energizes the electronic network through the down control relay 52 which in turn activates the timer 54 to cause the wetting arm 16 to assume its horizontal or spray position 34 as illustrated in FIG. 2.

In order to initiate the spraying cycle, the operator functions his spray transmitter (also not shown) to activate the up-spray radio control receiver 56. Upon receipt of an intelligible signal, the up-spray radio control receiver 56 energizes the electronic network for the spray cycle through the up-spray control relay 58 to activate the spray timer 60, the dribble timer 62 and the arm raise timer 64.

Figure 4:
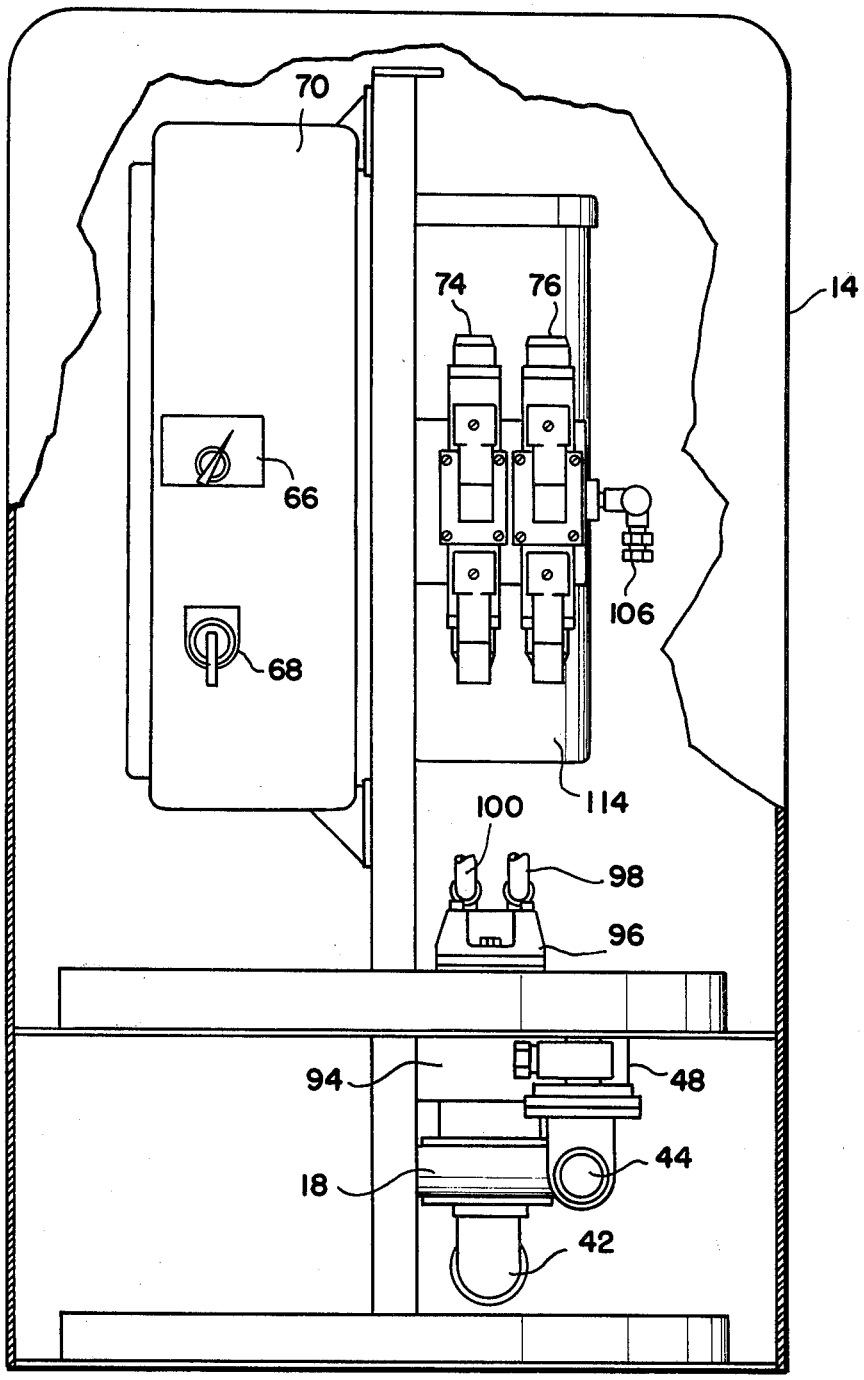
FIG. 4 is a right side elevational view of the control apparatus of FIG. 3.

In addition to the radio control effected through the radio control receivers 50, 56, it is also possible to manually control the wet salt system 10 through the use of the manual switches 66, 68 which are exteriorly mounted upon the control cabinet 70. See FIG. 4. The manual switch 68 manually controls the function of the solenoid valve 72 to lower the wetting arm 16 and the function of the solenoid valve 74 to raise the wetting arm 16 whenever so desired. The manual valve 66 provides manual back-up in case of automatic, radio control failure to manually open the solenoid valve 78 to cause liquid spray through the nozzles 40 and to function the solenoid valve 78 to terminate the spraying cycle. The manual switch 66 also includes an automatic contact to activate the spray timer 60 to thereby automatically control the timed cycle of spray.

In a third mode of operation, a flexible cord 80, 80′ (FIG. 7) interconnects into the control circuit 92 at the respective circuit terminals 82, 84 and 86, 88. The flexible cord 80, 80′ interconnects a pushbutton 90,90′ into the circuit in a manner to bypass the down radio control receiver 50 and the up-spray radio control receiver 56 to thereby permit remote, manual functioning of the up and down pivotal movements of the wetting arm 16 and the spray cycle through the wetting arm nozzles 40. Accordingly, the control circuit 92 may be functioned in any of three manners depending upon circumstances, that is, by utilizing remote radio transmitters (not shown) to activate the radio control receivers 50, 56, by utilizing the affixed manual controls 66, 68 or by utilizing the remote flexible cords 80, 80′ and pushbutton controls 90,90′ from a remote location.

Activation of the up-spray relay 58 energizes the pump motor 94 to initiate the flow of brine from the storage tank 12 to the spray nozzles 40 through the control valve 48.

The hydraulic pump 96 seats over the motor 94 and pressurizes the hydraulic lines 98, 100. The hydraulic line 100 interconnects the hydraulic fluid reservoir and the hydraulic line 98 leads to the hydraulic junction fitting 102 wherein the solenoid switches 72, 74 are mounted for control of the pivotal operation of the wetting arm 16. The circulating hydraulic fluid line 106 interconnects the fluid reservoir 104 with the hydraulic junction 102. The hydraulic lines 108, 110 interconnect the hydraulic junction 102 with the cylinder 30 for pivotal function of the wetting arm 16 in response to the control circuit 92.

Figure 5:
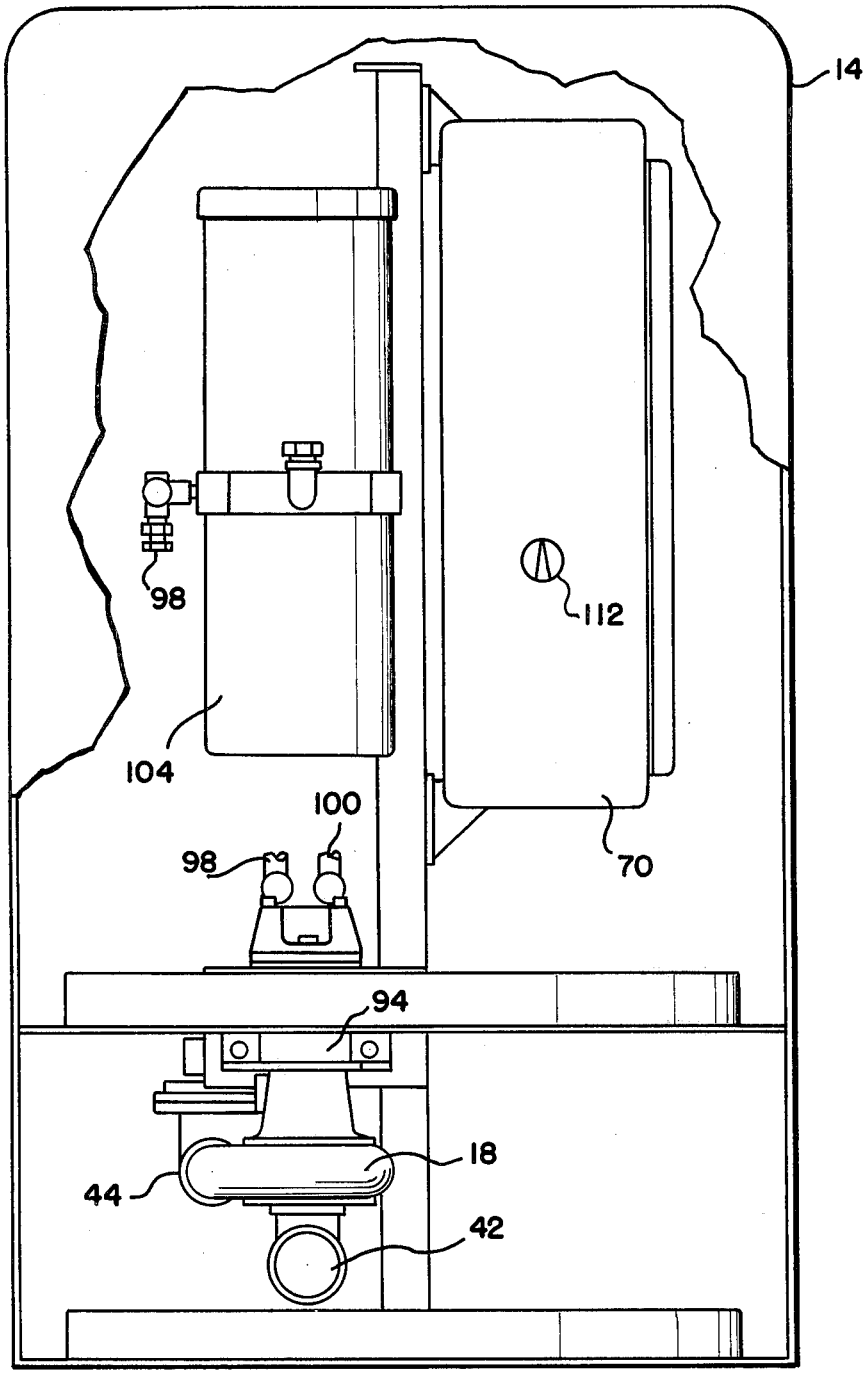
FIG. 5 is a left side elevational view of the control apparatus of FIG. 3.
Figure 6:
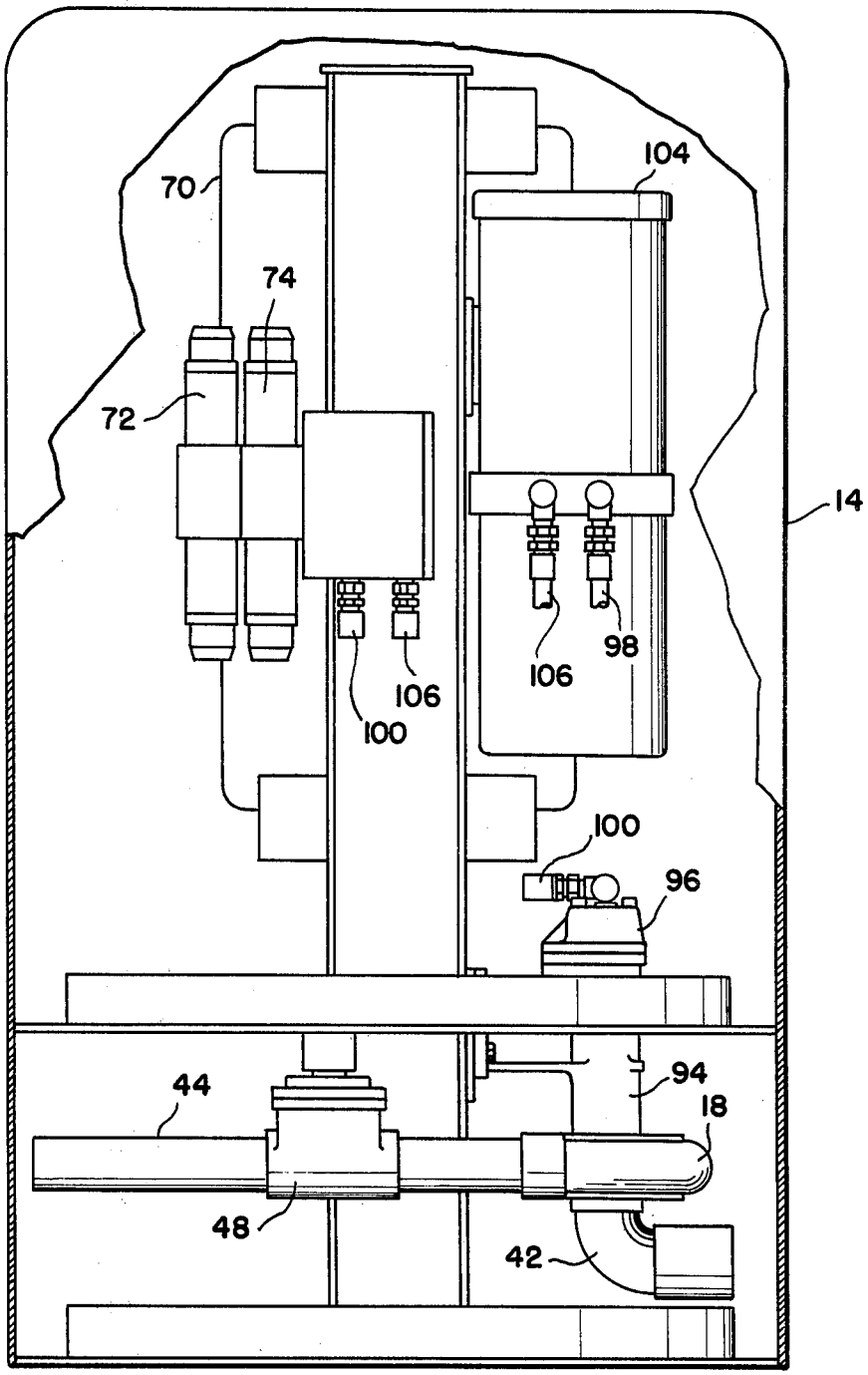
FIG. 6 is a rear elevational view of the control apparatus of FIG. 3.
Figure 7:
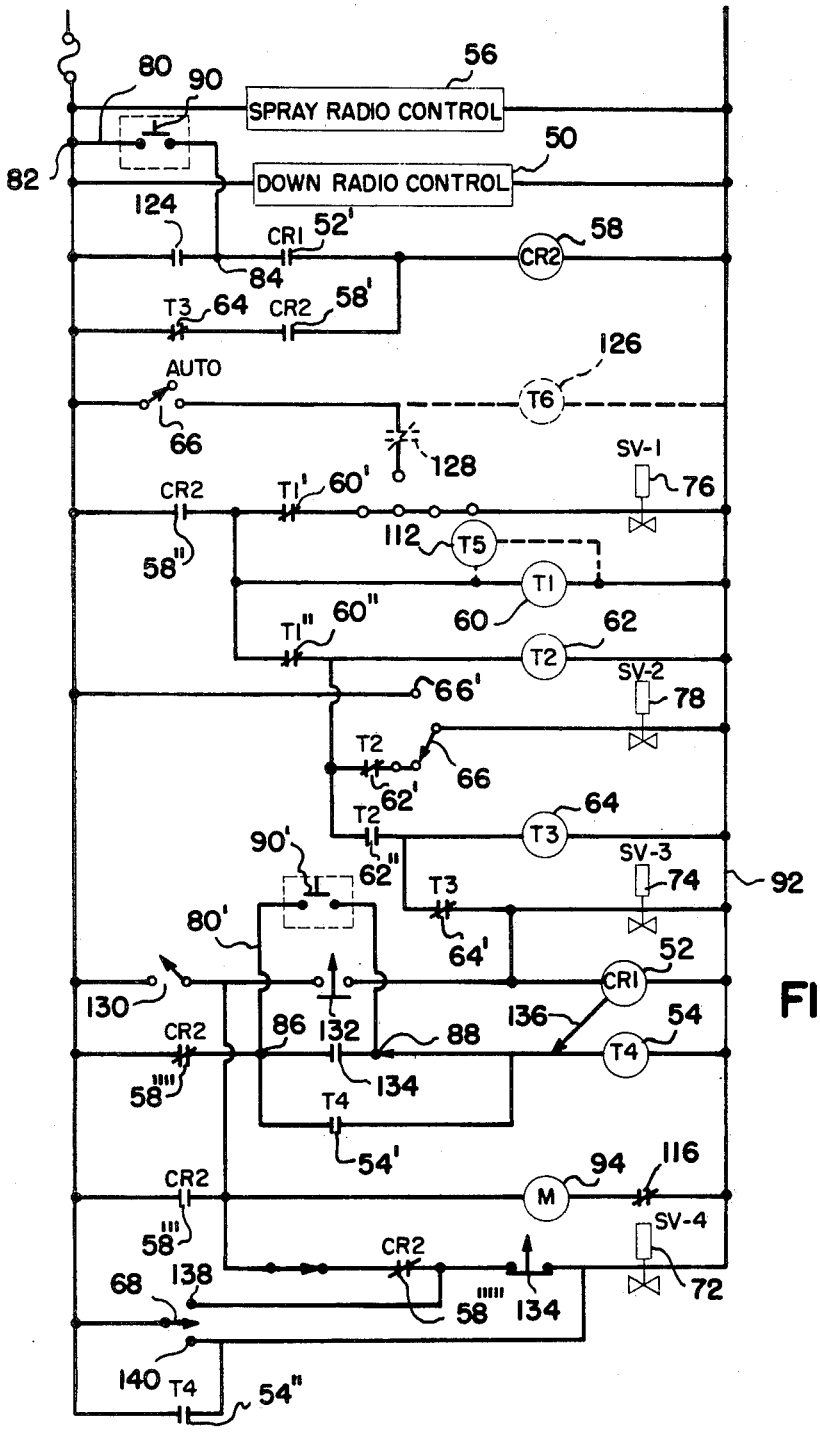
FIG. 7 is a schematic of the control circuit.

As best seen in FIG. 5, a manually operated timer 112 mounts exteriorly to the control cabinet 70 beneath the control enclosure 14, to facilitate on site adjustment of the spray cycle without special tools and without requiring any special skills. Accordingly, should field conditions require changes in the spray cycle, for example, the addition of more brine to the granular salt or less brine per truck load of granular salt, then the authorized personnel, for example a designated supervisor can manually operate the timer 112 to adjust the time of the desired spray cycle. As illustrated in FIG. 7, the manually adjustable timer 112 connects in parallel with the spray timer 60 for manual override purposes.

Referring to FIG. 7, the optional flexible cord 80 and push buttons 90, 90′ removably connect into the circuit to bypass the radio controls 50, 56 and to permit manual spray and arm pivoting operations. Function of the up spray radio control receiver 56 operates the interlock contact 50′, the spray close contact 124 and the up-spray relay 58. The manual switch 66 connects into the circuit to permit manual function of the system from the exterior of the cabinet 70. If desired, an additional optional timer, indicated at 126 in FIG. 7, but not elsewhere illustrated, can be connected into the circuit if so desired to function its closed contact 128 to permit an increased spray time. It is contemplated that the optional timer would be mounted on the control cabinet 70, but would not be provided with any easily adjusted features such as provided by the manually adjustable timer 112.

The manual switch 66 exteriorly mounts in the cabinet 70 and functions between manual spray on, manual spray off and automatic spray positions. The manual arm control switch 68 exteriorly mounts on the cabinet 70 and includes the motor switch 130, the up contact 132 and down contact 134. The push button 90' at the end of the flexible cord 80' controls manually the wetting arm 16 down cycle. The down radio control 56 operates the radio down contact 134. The timer contact 136 is functional by the up-spray radio control 50 between the latched position as illustrated to an unlatched position. The up-down manual switch 68 mounts exteriorly in the cabinet 70 and functions between the arm up contact 138 and the arm down contact 140.

Figure 3:
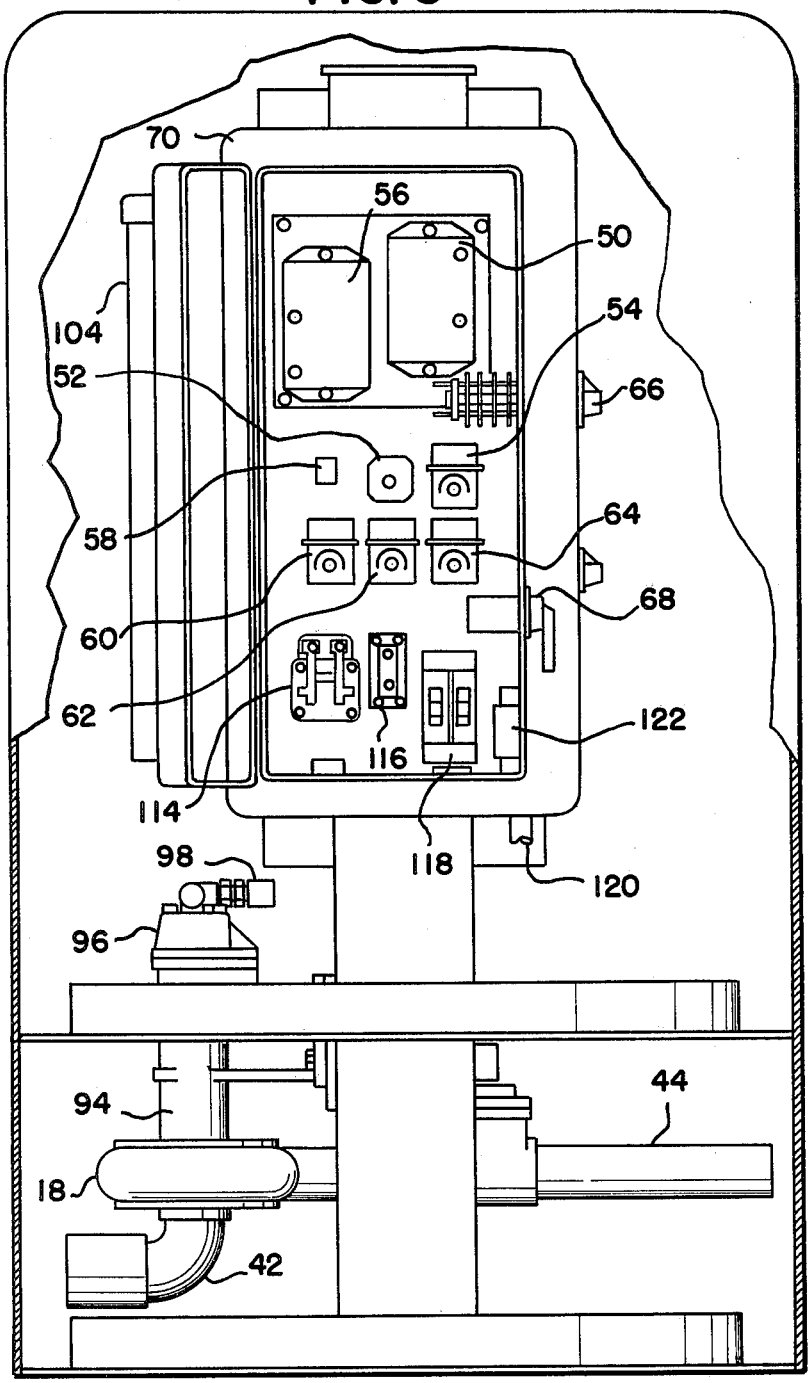
FIG. 3 is an enlarged, elevational view of the control apparatus with the cover broken away to expose interior construction details.

If desired, as illustrated in FIG. 3, the control cabinet 70 can also enclose the motor coil 114, the motor overload relay 116 and a suitable circuit breaker 118 in known manner. The electrical service 120 enters the cabinet 70 in usual manner and the required connections can be made at the interior junction box 122. It is noteworthy that the manual switches 66, 68 and the manually operated timer 112 mount exteriorly of the control cabinet 70 and beneath the control enclosure cover 14. In this manner, when the wet salt system 10 is in operation, the cover 14 can be removed to permit rapid manual functioning and adjustments whenever so desired. When the wet salt system 10 is not in operation, then the control enclosure cover 14 can be secured over all of the control equipment to thereby prevent tampering or vandalism by unauthorized personnel.

Referring now to FIG. 7, in operation, an operator (not shown) can function a radio transmitter (not shown) to activate the down radio control 50. The down control receiver 50 functions the down control relay actuator 52 (CR1), the down control normally open contact 52', the arm down timer actuator 54 (T4), and the arm down normally open contacts 54', 54''. This in turn activates the arm-down solenoid 72 (SV-4) to lower the wetting arm 16. The transmitter (not shown) is then employed to activate the up-spray receiver 56 for spray purposes.

The up-spray receiver 56 energizes the up-spray control relay actuator 58 (CR2) to function the up-spray normally open relay contacts 58', 58'', 58''' and the normally closed up-spray relay contacts 58'''', 58'''''. The function of the up-spray control relay actuator 58 (CR2) functions the spray timer actuator 60 (T1), the spray timer normally closed contacts 60', 60'', the dribble timer actuator 62 (T2), which operates the dribble timer normally closed contacts 62' and the dribble timer normally open contacts 62'' and the arm raise timer actuator 64 (T3) which functions the arm raise timer normally closed contacts 64'. Activation of the up-spray relay 58 (CR2) energizes the pump motor 94 (M) to thereby pump brine from the storage tank 12 to the spray nozzles 40 through the control valve 48 and the spray open solenoid 76. (SV-1). Upon completion of the timed spray cycle, the solenoid valve 78 (SV-2) is energized to stop the liquid flow and the solenoid valve 74 (SV-3) is energized to again raise the wetting arm 16.

The manual switch 68 manually controls the operation of the solenoid valve 72 (SV-4) for lowering the wetting arm 16 and the operation of the solenoid valve 74 (SV-3) for raising the wetting arm 16 upon completion of the spray cycle. The manual switch 66 permits either automatic operation of the spray close solenoid 78 (SV-2) when in the position illustrated in FIG. 7 or optionally, manually controller operation of the spray close solenoid valve 78 (SV-4) when moved to contact the manual contact 66'. The switch 66 automatic contact, as illustrated, automatically activates the dribble timer actuator 62 (T2) and the dribble timer contacts 62', 62''.

The flexible cord 80, 80' connects into the circuit 92 at the terminals 82, 84, and 86, 88 for manual control by the push button 90, 90' in a manner to bypass the down radio control receiver 50 and the up-spray radio control receiver 56 for remote function of the pivotal movements of the wetting arm 16 and spray through the nozzles 40.

Although the present invention has been described with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

What is claimed is:

1. In a wetted salt system suitable to extend the melting range of highway salt of the type including a liquid storage tank, a wetting arm pivotally connected at one end to a stationary support and having an unconnected end, the wetting arm comprising an enlongated bar and at least one nozzle supported near the unconnected end of the bar, and means to pivotally function the wetting arm relative to the support between an elevated position and a spray position; a brine pump taking its suction from the storage tank and delivering liquid under pressure to the spray nozzle; a hydraulic circuit to control the operation of the means to pivotally function the arm; an electrical control circuit including a first timer to control the time period the wetting arm remains in the said spray position and a second timer to control the time period of the flow of brine from the pump to the spray nozzle, first radio transmitter and receiver means to initiate the operation of the first timer and second radio transmitter and receiver means to initiate operation of the second timer; the improvement comprising a third timer connected in parallel to and being adapted to override the said second timer, the third timer including an electrically timed operation cycle and a manual timer adjustment knob, the adjustment knob being connected in the timer to vary the duration of the timed operation cycle, and manual means connected into the electrical control circuit to bypass the first and second radio transmitter and receiver means, the manual means comprising a flexible electrical cord and a switch, the manual means being adapted to manually function the up and down pivotal movements of the wetting arm and the spray cycle through the spray nozzle from a location remote from the electrical control circuit;

whereby the timed period of brine flow can be manually adjusted without requiring tools.

* * * * *